US006109978A

United States Patent [19]

Stellman et al.

[11] Patent Number: 6,109,978

[45] Date of Patent: Aug. 29, 2000

[54] CONNECTOR ASSEMBLY HAVING A PLURALITY OF ELECTRICAL CONNECTORS

[75] Inventors: Robert J. Stellman, Castro Valley; Pamela E. Wright, Fremont, both of Calif.

[73] Assignee: Nortel Networks Limited, Santa Clara, Calif.

[21] Appl. No.: 09/112,070

[22] Filed: Jul. 8, 1998

[51] Int. Cl.[7] ..... H01R 13/502

[52] U.S. Cl. ..... 439/701; 439/484; 439/676

[58] Field of Search ..... 439/49, 344, 484, 439/501, 502, 676, 701

[56] References Cited

U.S. PATENT DOCUMENTS 4,829,564 5/1989 Jarvis ..... 379/327

5,125,854 6/1992 Bassler et al. ..... 439/607

5,879,199 3/1999 Belopolsky ..... 439/701

5,971,789 10/1999 Sukegawa ..... 439/352

*Primary Examiner*—Kheim Nguyen

*Attorney, Agent, or Firm*—Blakely, Sokoloff, Taylor & Zafman LLP

[57] ABSTRACT

According to one aspect of the invention a connector assembly is provided for making an electrical connection with an electrical device having a plurality of electrical sockets. The connector assembly includes a mounting structure and a plurality of connection leads. Each connection lead includes an electrical cable and at least a first electrical connector secured to a first end of the cable. Each connection lead is secured to the mounting structure. The respective electrical connectors are mounted in position to the mounting structure so that movement of the mounting structure relatively towards the electrical device causes simultaneous engagement of each of the electrical connectors with a respective electrical socket of the electrical device.

16 Claims, 6 Drawing Sheets

CONNECTOR ASSEMBLY HAVING A PLURALITY OF ELECTRICAL CONNECTORS

BACKGROUND OF THE INVENTION

1). Field of the Invention

This invention relates generally to a connector assembly for making electrical connection with an electrical device having a plurality of electrical sockets. More specifically, the present invention relates to such an electrical connector assembly having a number of connection leads which are simultaneously engageable and disengageable with the electrical device.

2). Discussion of Related Art

Electrical assemblies, such as network assemblies or network components under test conditions, usually comprise an electrical host device having a plurality of electrical sockets, and a plurality of connection leads connected to the electrical sockets. Each connection lead is typically preconstructed to include an electric cable and a connector secured to an end of the cable. Each connection lead is connected to the electrical device with a connector of the electrical lead engaged with a respective electrical socket of the electrical device.

Electrical devices of the above kind typically have a large number of electrical sockets. A respective connection lead has to be engaged with each of the relatively large number of electrical sockets. To engage each of the connection leads with each of the electrical sockets is therefore a cumbersome, time consuming and labor intensive operation.

During testing of such electrical devices it is often required to test a large number of the electrical devices. A single set of connection leads would then be connected to each of the electrical devices and disconnected from each of the electrical devices. Connection and disconnection of connection leads is therefore an even more time consuming and labor intensive operation in a test environment.

SUMMARY OF THE INVENTION

According to one aspect of the invention a connector assembly is provided for making an electrical connection with an electrical device having a plurality of electrical sockets. The connector assembly includes a mounting structure and a plurality of connection leads. Each connection lead includes an electrical cable and at least a first electrical connector secured to a first end of the cable. Each connection lead is secured to the mounting structure. The respective electrical connectors are so mounted in position to the mounting structure so that movement of the mounting structure relatively towards the electrical device causes simultaneous engagement of each electrical connector with a respective electrical socket of the electrical device.

A handle is preferably provided on the mounting structure.

The electrical connector typically has a first portion against the mounting structure and a second portion, for engaging with a respective electrical socket, extending from the mounting structure.

The mounting structure may have a plurality of recesses. Each recess may support a first portion of a respective electrical connector, wherein a second portion of the electrical connector extends out of the recess.

The mounting structure may include first and second components which may be secured to one another to form the recess.

In order to prevent the connector from moving out of the recess, the connector may have a first formation and the mounting structure may have a second formation which engages with the first formation.

In one embodiment the electrical connectors have a plurality of separate electrical contacts.

At least one of the connection leads may further include a second electrical connector secured a second end of the cable opposing the first end of the cable. The electrical connectors secured to the first and second ends of the cable may all be in line. Alternatively, the electrical connectors secured to the first ends of the cables may be in a first line and the electrical connectors secured to the second ends of the cables may be in a second line substantially parallel to the first line.

According to another aspect of the invention a mounting structure is provided for a plurality of connection leads, each connection lead including an electrical cable and an electrical connector secured to an end of the cable. The mounting structure includes a first component and a second component which is securable to the first component. The first component may define a plurality of connector seat openings. Each connector seat opening may be capable of receiving a respective electrical connector of a respective connection lead. By securing the second component to the first component, the electrical connector may be mounted in position with the first portion of the electrical connector between the first and second components and a second portion of the electrical connector extending from the first and second components.

The mounting structure preferably has an opening through which the electrical cable can extend from the electrical connector out of the mounting structure.

The mounting structure may include a formation positioned to engage with the electrical connector to prevent the electrical connector from moving out of the mounting structure.

According to a further aspect of the invention an electrical assembly is provided including at least a first electrical device having a plurality of respective first electrical sockets, a first mounting structure, and a plurality of connection leads. Each connection lead may include an electrical cable and at least a first electrical connector secured to a first end of the cable. Each connection lead is secured to the first mounting structure. The respective first electrical connectors may so be mounted in position to the first mounting structure. The first mounting structure and the electrical device may be moved relatively towards one another so that each respective first electrical connectors is engaged with a respective first electrical socket of the first electrical device.

The electrical assembly may include at least a second electrical device having a plurality of respective second electrical sockets, and a second mounting structure. Each connection lead may include a second electrical connector secured to a second end of the cable opposing the first end. The respective second electrical connectors may so be mounted in position to the second mounting structure. The second mounting structure and the electrical device may be moved relatively towards one another so that each respective second electrical connectors is engaged with a respective second electrical socket of the second electrical device.

Alternatively, at least one of the connection leads may include at least a second electrical connector secured to a second end of the cable opposing the first end of the cable. The second electrical connector may be mounted in position to the first mounting structure so as to be engaged with one of the first electrical sockets of the first electrical device.

The invention further provides a method of constructing a connector assembly. A plurality of connection leads is provided. Each connection lead includes an electrical cable and an electrical connector secured to an end of the cable. The connection leads are secured to a mounting structure. The electrical connectors are thereby mounted in position to the mounting structure so as to simultaneously engage with respective electrical sockets of an electrical device upon movement of the mounting structure and the electrical device relatively towards one another.

Other features of the invention will become apparent in the brief description of the drawings and the detailed description of the invention which follow.

BRIEF DESCRIPTION OF THE DRAWINGS

The invention is further described by way of examples with reference to the accompanying drawings wherein like reference numerals indicate like or similar components and wherein.

DETAILED DESCRIPTION OF THE INVENTION

A connector assembly for making an electrical connection with an electrical device having a plurality of electrical sockets, and an electrical assembly are described. In the following description, for purposes of explanation, numerous specific details are set forth in order to provide a thorough understanding of the present invention. It will be evident, however, to one skilled in the art, that the present invention may be practiced without these specific details.

Figure 1:
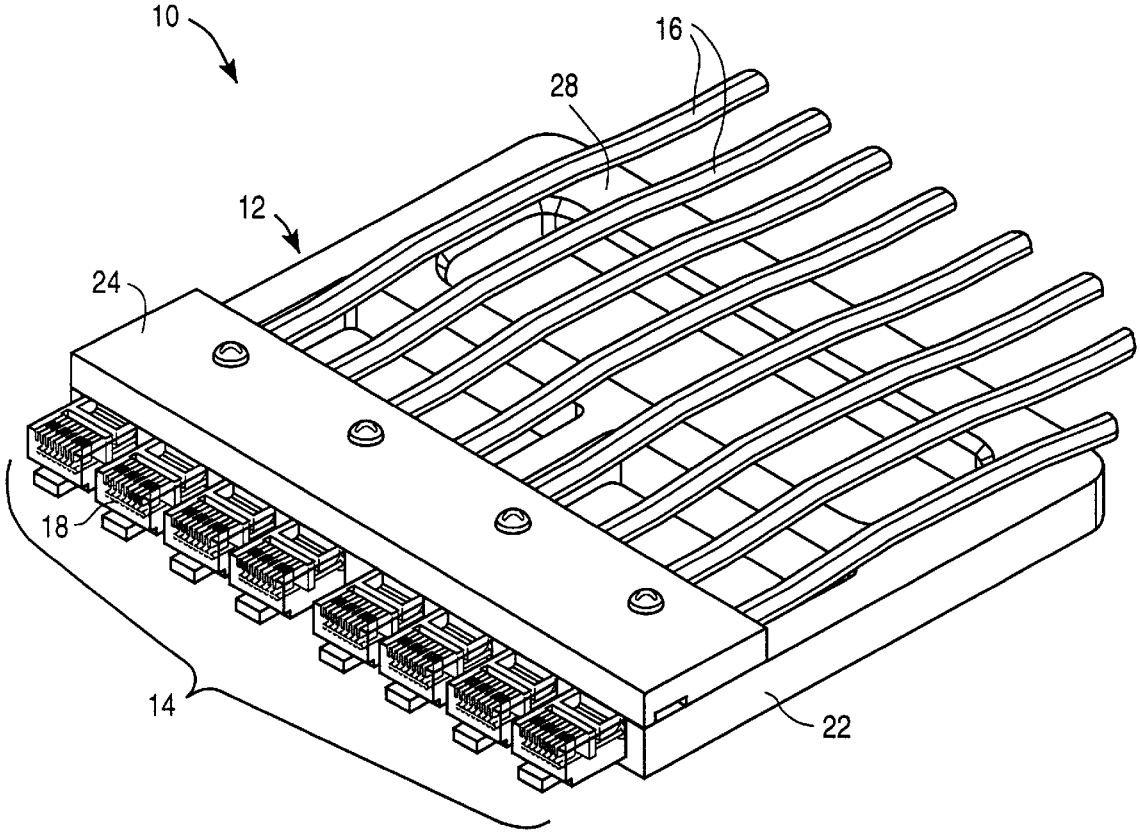
FIG. 1 is a perspective view of a connector assembly, according to one embodiment of the invention, for making an electrical connection with an electrical device having a plurality of electrical sockets.

FIG. 1 of the accompanying drawings illustrates a connector assembly 10, according to the invention, which is used for making an electrical connection with an electrical device having a plurality of electrical sockets. The connector assembly 10 includes a mounting structure 12 and eight connection leads 14 secured to the mounting structure 12.

Figure 2:
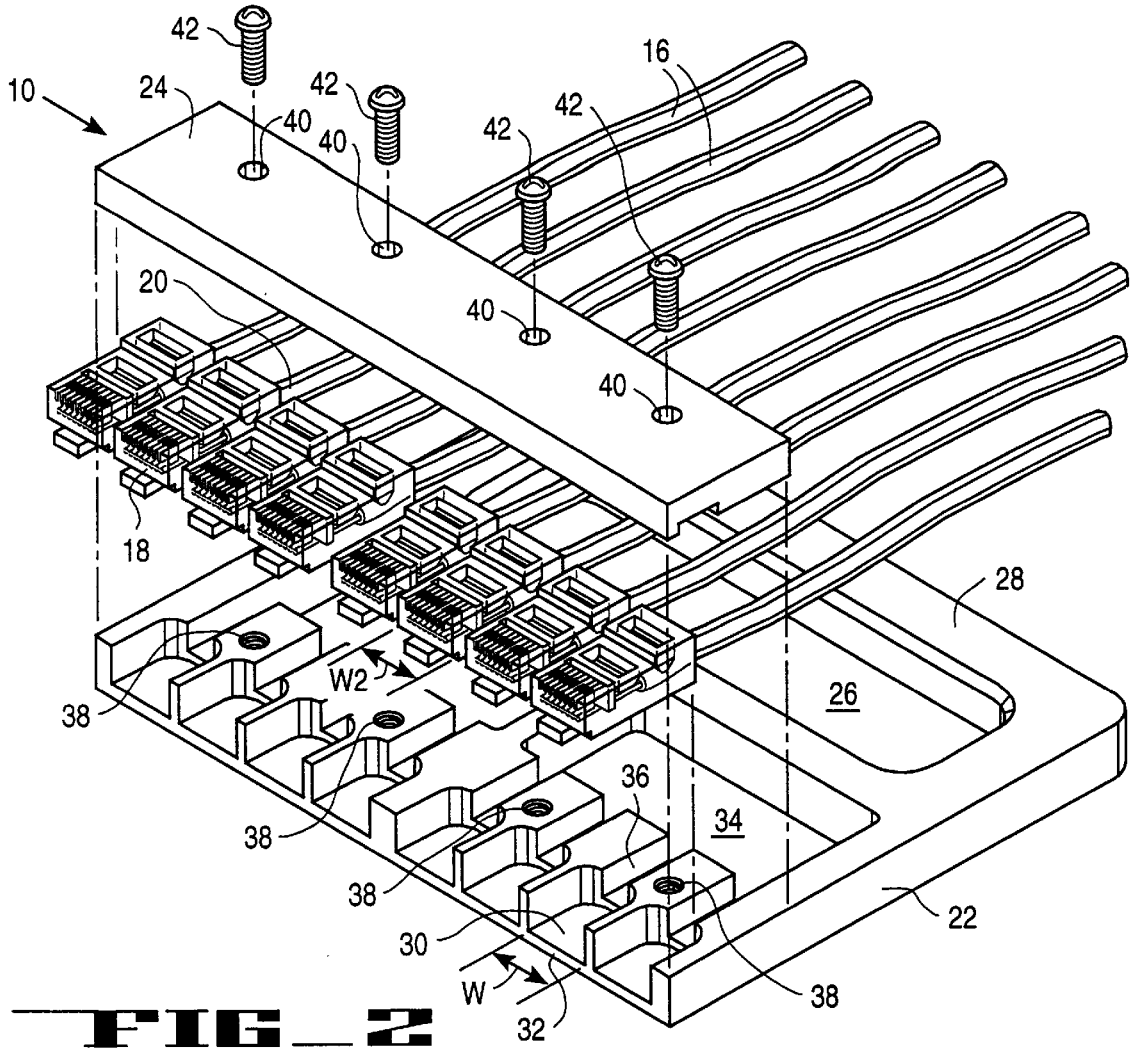
FIG. 2 is a perspective view in exploded form of the connector assembly of FIG. 1.

FIG. 2 illustrates the connector assembly 10 in exploded form.

Each connection lead 14 is preconstructed to include an electrical cable 16 and an electrical connector 18 secured to an end 20 of the electrical cable 16. The connection leads 14 may be RJ-47 cables which are known in the art and the electrical connectors 18 may, accordingly, be RJ-47 connectors.

The mounting structure 12 includes a first component 22 and a second component 24, each of which may be made of an electrically insulative material such as Delrin which is a material known in the art.

The first component 22 is made in the form of a sheet. An opening 26 is made in the first component 22 on one side thereof so as to leave a handle 28 at an edge of the first component 22. A plurality of connector seat openings 30 are formed in the first component 22 on a side of the first component 22 opposing the handle 28. Each connector seat opening 30 is formed in an upper surface of the first component 22, leaving a flange portion 32 between the connector seat opening 30 and a lower surface of the first component 22. Each connector seat opening 30 has a width (W1) which substantially corresponds with a width (W2) of each of the electrical connectors 18.

Openings 34 are formed through the first component 22 in areas between the opening 26 and the connector seat openings 30. Slots 36 are formed in the upper surface of the first component 22. Each slot 36 extends from a respective connector seat opening 30 to one of the openings 34. Each slot 36 is slightly wider than each of the electrical cables 16.

Threaded holes 38 are formed through the first component 22 in areas between the slots 36.

The second component 24 is in the form of a sheet and has a number of holes 40 formed therethrough.

In constructing the connector assembly 10, each of the electrical connectors 18 of the connection leads 14 is positioned in a respective connector seat opening 30 in the first component 22, with the electrical cable 16 of the connection lead 14 being positioned within a respective slot 36 in the first component 22. The second component 24 is then positioned over the electrical connectors 18 and fasteners such as screws 42 are inserted through the holes 40 and screwed into the threaded holes 38. The second component 24 is thereby secured to the first component 22 with the (preconstructed) connection leads 14 secured between the first and second components 22 and 24. The electrical connectors 18 are mounted relatively securely between the first and second components 22 and 24.

Figure 3:
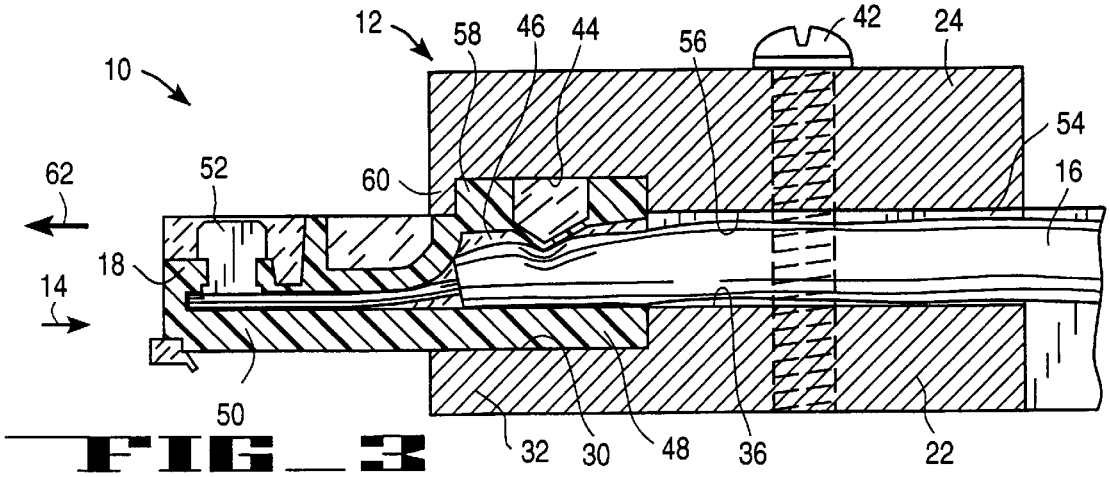
FIG. 3 is a sectioned side view of a portion of the connector assembly of FIG. 1.

FIG. 3 illustrates in cross section a portion of the connector assembly 10 after the second component 24 is secured to the first component 22. The respective connector seat openings 30 in the first component 22, together with an opposing surface 44 of the second component 24 define a recess 46 which contain and support a first portion 48 of a respective electrical connector 18. A second portion 50 of the electrical connector 18 extends out of the recess 46 from the first and second components 22 and 24. Electrical contacts 52 are provided on the second portion 50 of the electrical connector 18 extending from the first and second portions 48 and 50. Although only a single electrical contact 52 is shown in FIG. 3, it should be understood that each electrical connector 18 may have two or more separate electrical contacts, located behind one another, one or more of which may be connected to a respective wire of the electrical cable 16.

A respective hole 54 is defined jointly by a respective slot 36 in the first component 22, and an opposing surface 56 of the second component 24. The electrical cable 16 of a respective connection lead 14 extends from the first portion 48 of the electrical connector 18 located in the recess 46, through the hole 54 out of the mounting structure 12.

The first portion 48 of the electrical connector 18 located in the recess 46 has a raised step formation 58. The second component 24 has a hook formation 60 located next to the raised step formation 58. Interengagement of the raised step formation 58 and the hook formation 60 prevents the electrical connector 18 from moving in a direction 62 which is out of the recess 46 in the mounting structure 12.

Figure 4A:
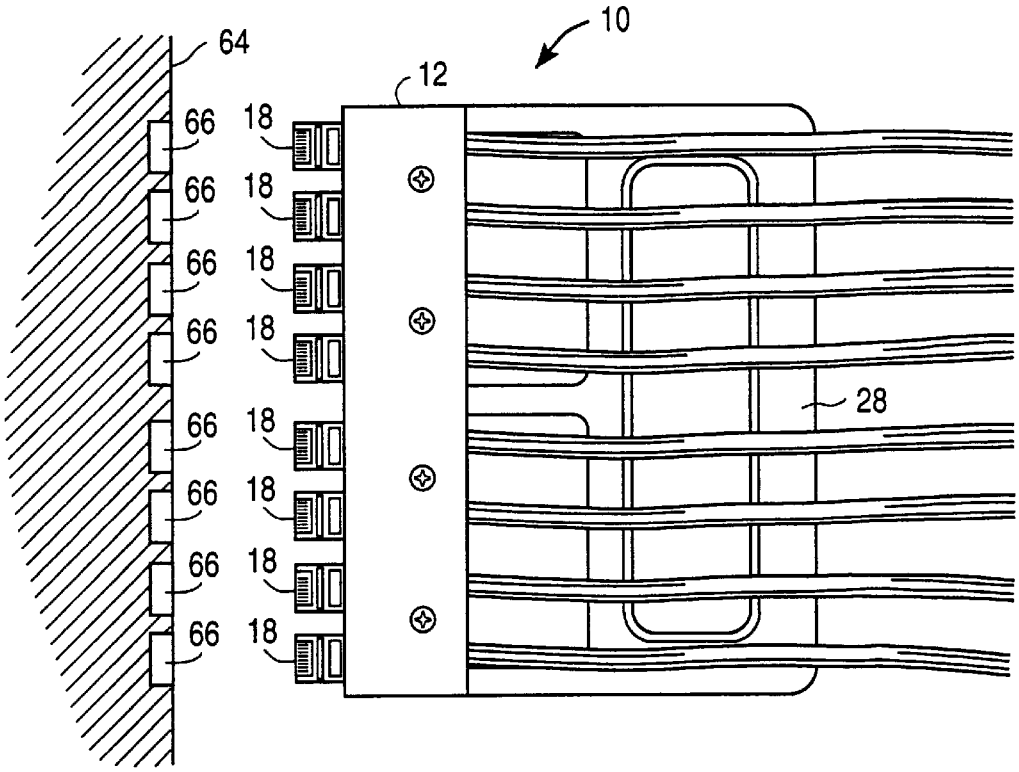
FIG. 4A is a side view of the connector assembly of FIG. 1 before making an electrical connection with an electrical device.

FIG. 4A illustrates the connector assembly 10 and an electrical device 64 to which connection has to be made.

Figure 4B:
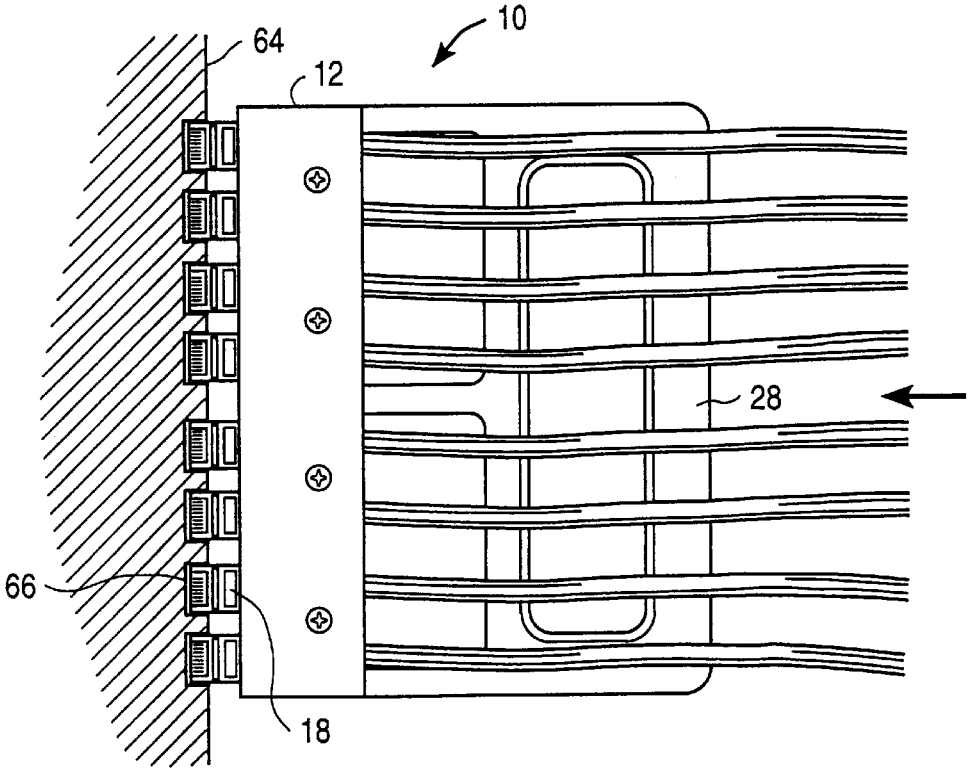
FIG. 4B is a view similar to FIG. 4A after making an electrical connection with the electrical device.

The electrical device 64 has a number of electrical sockets 66 which are spaced from one another and arranged in a manner similar to the electrical connectors 18 of the connector assembly 10. The connector assembly 10 may be positioned relatively to the electrical device 64 with each electrical connector 18 aligned with a respective electrical socket 66 of the electrical device 64. The respective electrical connectors 18 are mounted in position to the mounting structure 12 so that, when the mounting structure 12 is moved towards the electrical device 64, each of the electrical connectors 18 simultaneously engages with a respective electrical socket 66 of the electrical device 64, as shown in FIG. 4B. The handle 28 may be used by an operator in order to align the electrical connectors 18 with the electrical sockets 66 and to move the mounting structure 12 towards the electrical device 64. The handle 28 may also be used to pull the mounting structure 12 away from the electrical device 64, thereby disengaging the electrical connectors 18 with the electrical sockets 66.

It can be seen from the aforegoing description that a plurality of electrical connectors 18 can simultaneously be engaged with a plurality of electrical sockets 66 in one easy operation involving handling and movement of the connector assembly 10. Electrical connection can thus be made without the need for engaging each of the electrical connectors 18 individually with a respective electrical socket 66. A large amount of time and labor is thus saved. Furthermore, the electrical connectors 18 are arranged in easily manageable groups of eight. There is therefore less chance of mixing up the electrical connectors 18 as often occurs when a large number of electrical connectors are loosely bundled together.

Figure 5:
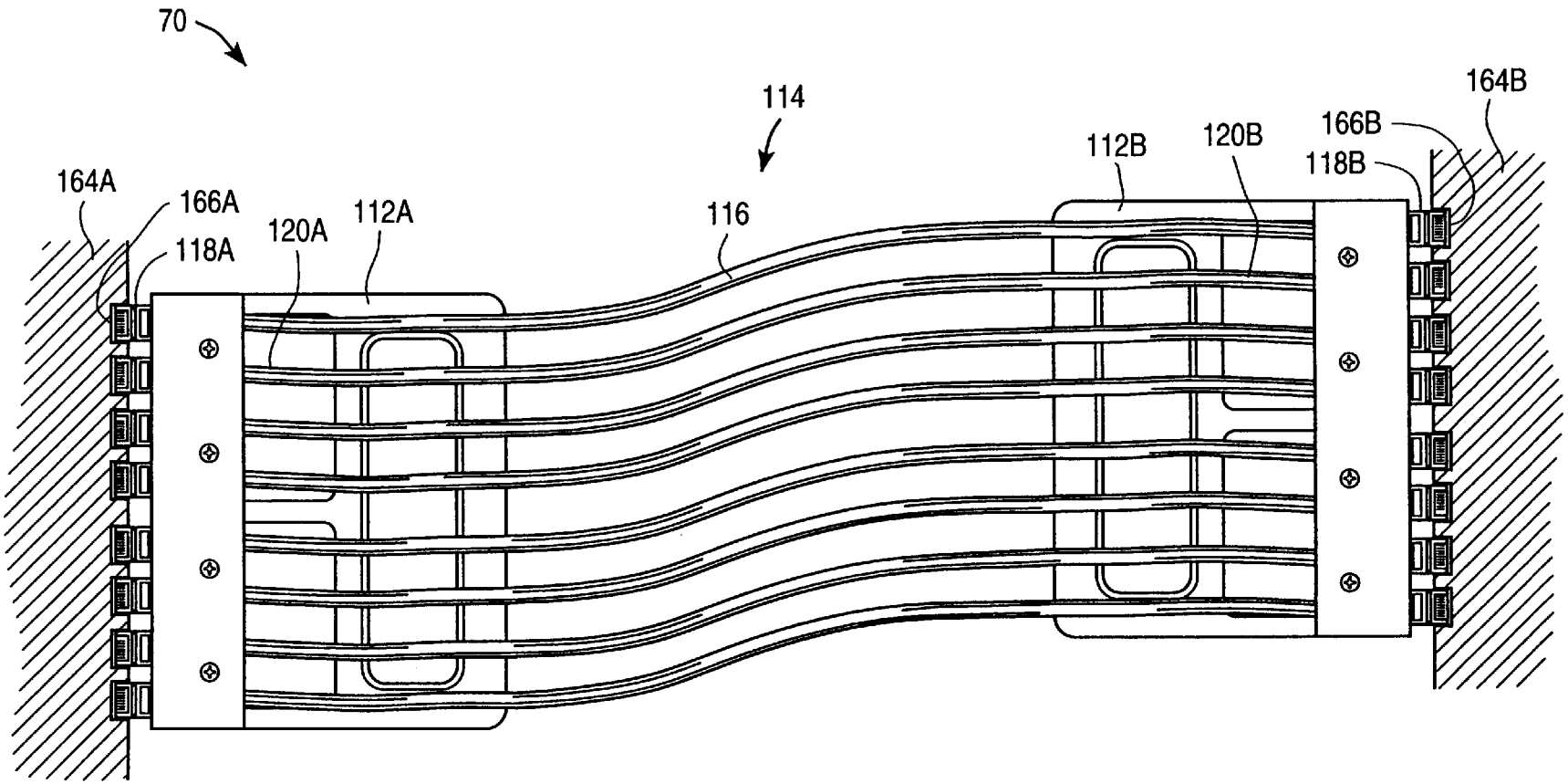
FIG. 5 is a side view of an electrical assembly having first and second electrical devices and first and second connector assemblies connected to one another, each connector assembly making an electrical connection with a respective electrical device.

FIG. 5 illustrates one electrical assembly 70, according to the invention, in which connector assemblies such as the connector assembly 10 of FIG. 1 may be employed. The electrical assembly 70 includes a first electrical device 164A, a second electrical device 164B, a first mounting structure 112A, a second mounting structure 112B, and a plurality of connection leads 114.

The first electrical device 164A has a plurality of respective first electrical sockets 166A and the second electrical device 164B has a plurality of respective second electrical sockets 166B.

Each connection lead 114 includes an electrical cable 116 having a first end 120A and a second end 120B opposing the first end 120A. A respective first electrical connector 118A is connected to a respective first end 120A of each electrical cable 116. A respective second electrical connector 118B is connected to a respective second end 120B of each cable 116. The first mounting structure 112A is moved relatively towards the first electrical device 164A so that each of the respective first electrical connectors 118A is engaged with each of the respective first electrical sockets 166A. Similarly, the second mounting structure 112B is moved towards the second electrical device 164B so that each of the respective second electrical connectors 118B is engaged with a respective second electrical socket 166B. The first and second electrical devices 164A and 164B are so easily connected to one another by the plurality of electrical cables 116. The first electrical device 164A, may, for example, be a network module such as a Bay Networks 5000 Concentrator as sold by Bay Networks, Incorporated of Santa Clara, Calif. and the second electrical device 164B may, for example, be a traffic generator such as a NetCom Smart Bits Traffic Generator as sold by Netcom of San Jose, Calif. which may be used for testing the first electrical device 164A.

The connector assembly 10 of FIG. 1 has a plurality of individual connection leads 14 which may be used in a manner as illustrated in FIG. 5 to connect two electrical devices (164A and 164B) to one another. In certain instances, primarily during testing of electrical devices, it may be required to connect one or more first electrical sockets 66 of an electrical device and one or more second electrical sockets of the same electrical device to one another.

Figure 6:
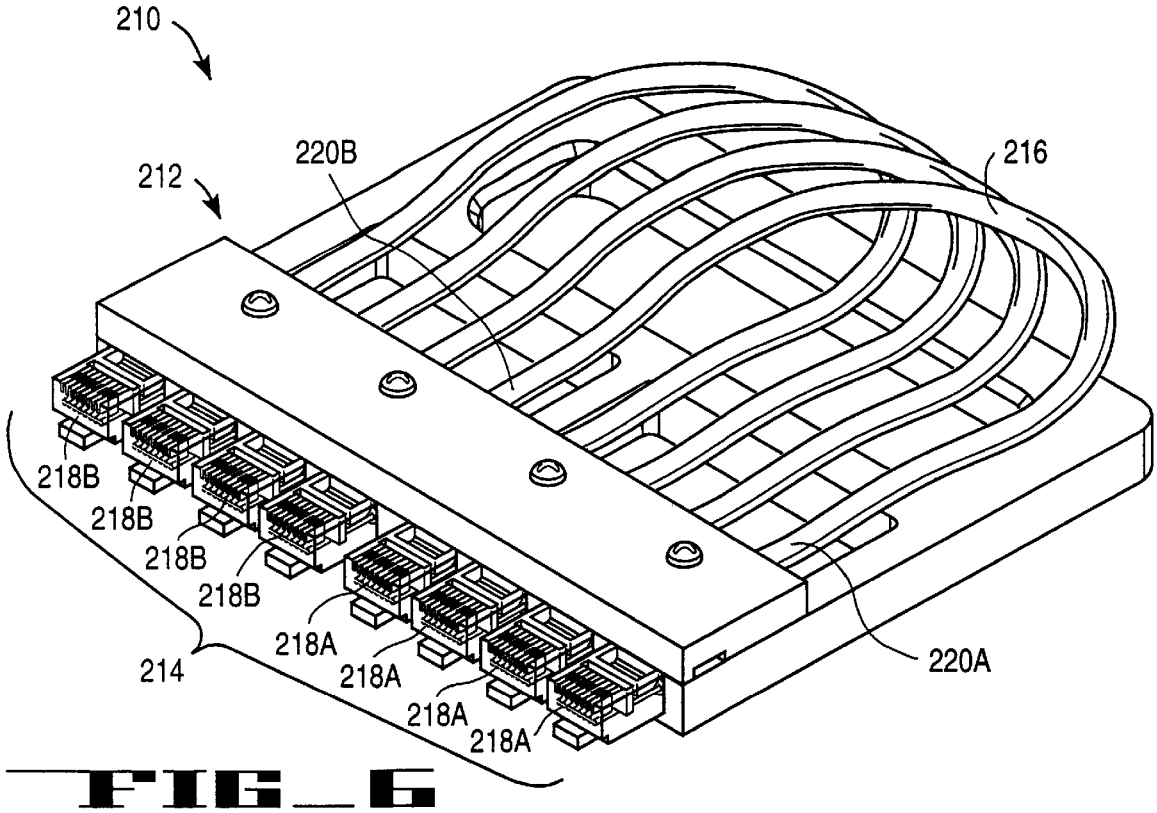
FIG. 6 is a perspective view of a connector assembly, according to another embodiment of the invention, having connection leads, each connection lead having two opposing electrical connectors, wherein all the electrical connectors of the connection leads are located on a same side of the electrical connector assembly.

FIG. 6 illustrates a connector assembly 210 which may be used for such a purpose. The connector assembly 210 includes a mounting structure 212 and four connection leads 214 secured to the mounting structure 212. Each connection lead 214 is preconstructed to include an electrical cable 216 having a first end 220A and a second end 220B opposing the first end, a first electrical connector 218A secured to the first end 220A of the electrical cable 216 and a second electrical connector 218B secured to the second end 220B of the electrical cable. The electrical cable 216 is looped back and the first and second electrical connectors 218A and 218B are mounted together to the mounting structure 212.

The connector assembly 210 is the same as the connector assembly 10 of FIG. 1 in all other respects.

Figure 7:
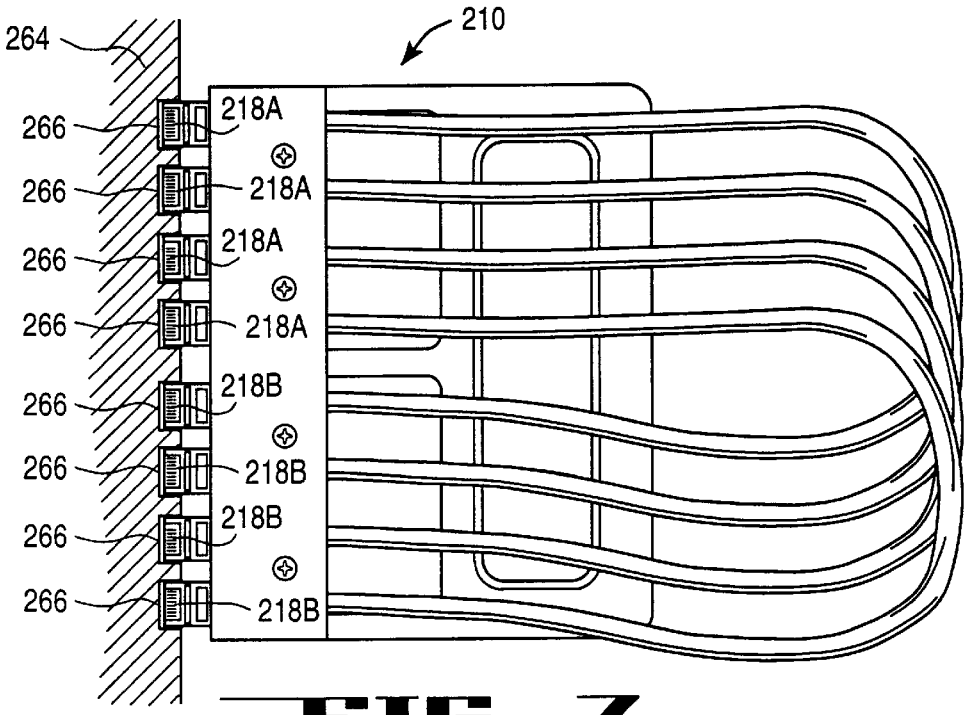
FIG. 7 is a side view illustrating how the connector assembly of FIG. 6 is used for connecting electrical sockets of a single electrical device to one another.

FIG. 7 illustrates how the connector assembly 210 may be connected to an electrical device 264. The electrical device 264 has a plurality of electrical sockets 266. Each respective first electrical connector 218A is engaged with a respective electrical socket 266 and each respective second electrical connector 218B is engaged with a respective electrical socket 266. The electrical sockets 266 are thereby connected to one another. Moreover, the electrical sockets 266 are connected to one another by movement of the connector assembly 210 towards the electrical device 264. The electrical device 264 may, for example, be one of many network modules, such as Bay Networks 5000 Concentrators, under test and having electrical sockets 266 which have to be connected to one another for purposes of testing the modules. The electrical sockets 266 of one of the modules can quickly and easily be connected to one another by means of the connector assembly 210 and quickly and easily be disconnected from one another after the module has been tested. The connector assembly 210 can then be used for connecting electrical sockets of a next module to be tested, etc.

In FIG. 1, the electrical connectors 18 are all arranged in a single line. Such an arrangement of the electrical connectors 18 is particularly suitable for making an electrical connection with an electrical device having electrical sockets which are all located in a line. Similarly, the electrical connectors 218A of FIG. 6 are all located in a line. The arrangement of electrical connectors 218A and 218B is therefore also suitable for making an electrical connection with an electrical device having electrical sockets which are located in a single line.

Figure 8:
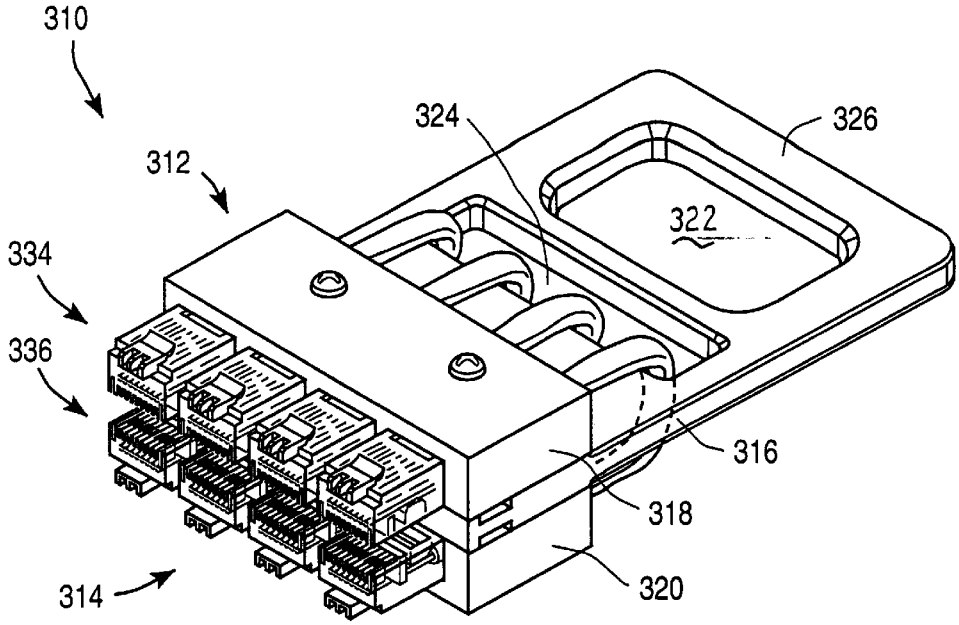
FIG. 8 is a perspective view of a connector assembly, according to a further embodiment of the invention, for making an electrical connection to an electrical device, the connector assembly having electrical connectors which are located in first and second substantially parallel lines.

FIG. 8 illustrates a connector assembly 310 having electrical connectors in a different configuration.

The connector assembly 310 includes a mounting structure 312 and four connection leads 314.

The mounting structure includes a first component 316, a second component 318, and a third component 320.

The first component 316 may be made of an electrically insulative material such as Delrin. First and second openings, 322 and 324 respectively, are formed through the first component 316. By forming the first opening 322, a handle 326 is provided at one end of the first component 316.

Figure 9:
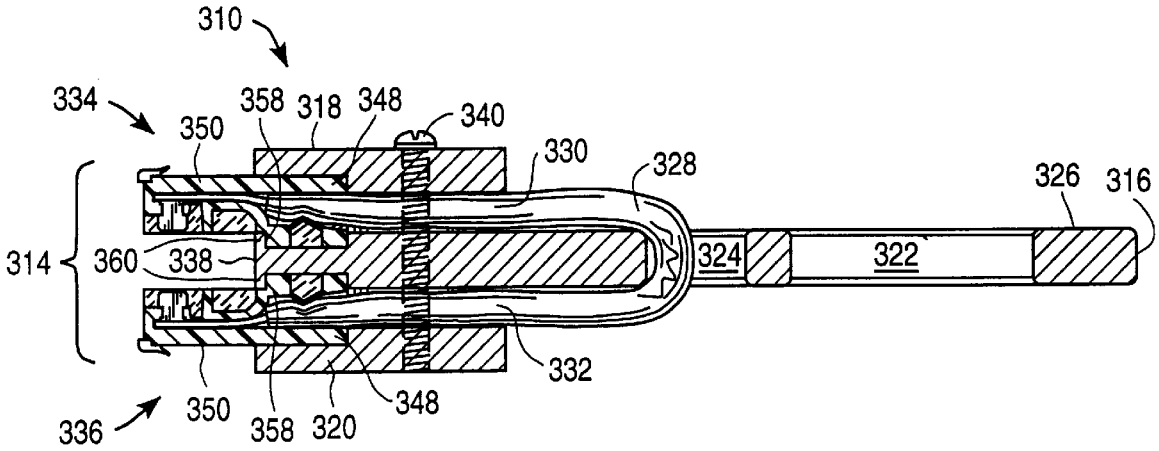
FIG. 9 is a sectioned side view of the connector assembly of FIG. 8.

As can be seen in FIG. 9, which is a sectioned side view of the connector assembly 310, each connection lead 314 is preconstructed to include an electrical cable 328 having first and second opposing ends 330 and 332 respectively, a first electrical connector 334 secured to the first end 330 of the electrical cable 328, and a second electrical connector 336 secured to the second end 332 of the electrical cable 328.

The connection lead 314 is inserted through the second opening 324 with the first and second electrical connectors 334 and 336 located on opposing sides of the first component 316. The electrical cable 328 is then folded and the first and second electrical connectors 334 and 336 are located opposing one another over an edge 338 of the first component 316. The second component 318 is then located over the first electrical connector 334, and the third component 320 is located over the second electrical connector 336. The first, second, and third components 316, 318, and 320 are then secured to one another by means of a fastener such as a screw 340 which is inserted through the second component 318, through the first component 316, and screwed into the third component 320. The electrical connectors 334 and 336 are so mounted to the mounting structure 312 with a first portion 348 of each electrical connector 334 or 336 located between the first component 316 and either the second component 318 or the third component 320, and a second portion 350 of each electrical connector 334 or 336 extending from the first, second, and third component 316, 318, and 320.

Each electrical connector 334 and 336 has a raised step formation 358. Two hook formations 360 are formed at the edge 338 of the first component 316 on opposing sides of the first component 316. The raised step formations 358 engage with the hook formations 360 to prevent the electrical connectors 334 and 336 from moving out of the mounting structure 312.

The connector assembly 310 therefore has four connection leads 314 with the respective first electrical connectors 334 located in a first line, and the respective second electrical connectors 336 located in a second line which is substantially parallel to the first line.

The connector assembly 310 may be used for making an electrical connection with an electrical device having electrical sockets which are not all in a single line. Particularly, the connector assembly 310 may be used for making an electrical connection with an electrical device having electrical sockets in first and second substantially parallel lines.

While certain exemplary embodiments have been described and shown in the accompanying drawings, it is to be understood that such embodiments are merely illustrative and not restrictive of the current invention, and that this invention is not restricted to the specific constructions and arrangements shown and described, since modifications may occur to those ordinarily skilled in the art.

For example, although the connector assemblies for making electrical connection, as hereinbefore described, all have male electrical connectors, it should be understood that the invention is not limited to male electrical connectors alone.

What is claimed:

1. A connector assembly for making an electrical connection with an electrical device having a plurality of electrical sockets, the connector assembly including:

a mounting structure including a handle;

a plurality of connection leads, each connection lead including an electrical cable and at least a first electrical connector secured to a first end of the cable, the respective connection leads being secured to the mounting structure with the respective electrical connectors being mounted in position to the mounting structure so that movement of the mounting structure relatively towards the electrical device causes simultaneous engagement of each electrical connector with a respective electrical socket of the electrical device and the movement of the mounting structure relatively away from the electrical device causes simultaneous disengagement of each electrical connector with the respective electrical socket of the electrical device; and the handle for moving the mounting structure relatively towards and away from the electrical device.

2. The connector assembly of claim 1 wherein each electrical connector has first portion against the mounting structure and second portion, for engaging with a respective electrical socket of the electrical device, extending from the mounting structure.

3. The connector assembly of claim 1 wherein the mounting structure has a plurality of recesses, each recess supporting a first portion of a respective electrical connector, and a second portion of the electrical connector extends out of the recess.

4. The connector assembly of claim 3 wherein the mounting structure includes first and second components which are secured to one another to form the recess.

5. The connector assembly of claim 4 wherein the connector has a first formation and the mounting structure has a second formation which engages with the first formation to prevent the connector from moving out of the recess.

6. The connector assembly of claim 1 wherein each connector has a plurality of separate electrical contacts.

7. The connector assembly of claim 1 wherein at least one of the connection leads further includes a second electrical connector secured to a second end of the cable opposing the first end of the cable.

8. The connector assembly of claim 7 wherein the electrical connectors secured to the first and second ends of the cables are all in line.

9. The connector assembly of claim 7 wherein the electrical connectors secured to the first and second ends of the cables are in a first line and the electrical connectors secured to the second ends of the cables are in a second line substantially parallel to the first line.

10. A connector assembly for making an electrical connection with an electrical device having a plurality of electrical sockets, the connector assembly including:

a mounting structure; and a plurality of connection leads, each connection lead including an electrical cable having first and second opposing ends, a first electrical connector secured to the first end of the cable, a second electrical connector secured to a second end of the cable, the respective connection leads being secured to the mounting structure with the respective first and second electrical connectors of the respective connection leads being mounted in position to the mounting structure so that movement of the mounting structure relatively towards the electrical device causes simultaneous engagement of each of the electrical connectors with a respective electrical socket of the electrical device.

11. A mounting structure for a plurality of connection leads, each connection lead including an electrical cable and an electrical connector secured to an end of the cable, the mounting structure including:

a first component including a handle defining a plurality of connector seat openings, each connector seat opening capable of receiving a respective electrical connector of a respective electrical cable; and a second component which is securable to the first component, thereby securing the electrical leads to the mounting structure with the electrical connectors mounted in position with a first portion of the electrical connectors between the first and second components and a second portion of the electrical connector extending from the first and second components.

12. The mounting structure of claim 1 which includes a formation positioned to engage with the electrical connector to prevent the electrical connector from moving out of the mounting structure.

13. An electrical assembly including:

at least a first electrical device having a plurality of respective first electrical sockets;

a first mounting structure including a handle; and a plurality of connection leads, each connection lead including an electrical cable and at least a first electrical connector secured to a first end of the cable, the respective connection leads being secured to the first mounting structure with the respective first electrical connectors being mounted in position to the first mounting structure and the first mounting structure and the electrical device being moved relatively towards one another so that each respective electrical connector is engaged with a respective first electrical socket of the first electrical device.

14. The electrical assembly of claim 13 which includes:

at least a second electrical device having a plurality of respective second electrical sockets; and a second mounting structure wherein each connection lead includes at least a second electrical connector secured to a second end of the cable opposing the first end, the respective connection leads being secured to the second mounting structure with the respective second electrical connectors being mounted in position to the second mounting structure and the second mounting structure and the second electrical device being moved relatively towards one another so that each respective second electrical connector is engaged with a respective second electrical socket of the second electrical device.

15. The electrical device of claim 13 wherein at least one of the connection leads includes at least a second electrical connector secured to a second end of the cable opposing the first end, the second electrical connector being mounted in position to the first mounting structure so as to be engaged with one of the first electrical sockets of the first electrical device.

16. A method of constructing a connector assembly, including the steps of:

securing a plurality of connection leads to a mounting structure including a handle, each connection lead including an electrical cable and an electrical connector secured to an end of the cable, the electrical connectors being mounted in position to the mounting structure so as to simultaneously engage with respective electrical sockets of an electrical device upon movement of the mounting structure and the electrical device relatively towards one another.

* * * * *